US005720139A

United States Patent [19]

Sorkin

[11] Patent Number: 5,720,139

[45] Date of Patent: Feb. 24, 1998

[54] METHOD AND APPARATUS FOR INSTALLING A MULTI-STRAND ANCHORAGE SYSTEM

[76] Inventor: Felix L. Sorkin, 4115B Greenbriar Dr., Stafford, Tex. 77477

[21] Appl. No.: 606,559

[22] Filed: Feb. 26, 1996

[51] Int. Cl.[6] ..... E04C 5/08

[52] U.S. Cl. ..... 52/223.13

[58] Field of Search ..... 52/223.13, 292

[56] References Cited

U.S. PATENT DOCUMENTS

| | | | |
|---|---|---|---|
| 3,351,320 | 11/1967 | Harvey | 52/223.13 X |
| 3,795,949 | 3/1974 | Shorter | 52/223.13 X |
| 4,261,149 | 4/1981 | Gustafson | 52/292 |
| 4,663,907 | 5/1987 | Ripoll | 52/223.13 |
| 4,674,907 | 6/1987 | Shewchuk | 52/292 X |
| 5,234,290 | 8/1993 | Collins | 52/292 X |
| 5,267,420 | 12/1993 | Segman | 52/292 |
| 5,345,742 | 9/1994 | Rogowsky | 52/223.13 X |
| 5,469,677 | 11/1995 | Luthi | 52/223.13 |

OTHER PUBLICATIONS

VSL Corporation, VSL Post-Tensioning Systems, Mar. 1994, pp. 1–31.

*Primary Examiner*—Carl D. Friedman
*Assistant Examiner*—Beth A. Aubrey

[57] ABSTRACT

An anchoring apparatus for a multi-strand anchorage system including an anchor plate having a front side and a back side, a plurality of tendon-receiving passageways formed in the anchor plate, and a hole formed in the anchor plate and extending so as to open on a front side and a back side of the anchor plate. Each of the tendon-receiving passageways opens on the front side and opens on the back side of the anchor plate. Each of the tendon-receiving passageways tapers so as to have a narrow diameter adjacent the back side of the anchor plate and a wide diameter adjacent the front side of the anchor plate. The hole is an unmachined cast hole.

7 Claims, 2 Drawing Sheets

METHOD AND APPARATUS FOR INSTALLING A MULTI-STRAND ANCHORAGE SYSTEM

TECHNICAL FIELD

The present invention relates to methods and apparatus for installing multi-strand post-tension systems. More particularly, the present invention relates to anchorages as used in such multi-strand systems. Furthermore, the present invention relates to methods for transmitting grout into the interior of anchors and ducts used in such multi-strand post-tension systems.

BACKGROUND ART

Multi-strand post-tensioning systems are used in a wide variety of applications. Conventionally, such systems are used for all types of slabs in buildings, bridge decks, and similar applications. Typically, a plurality of strands are placed so as to extend through ducts. The ends of the strands which extend outwardly of the ducts are placed into anchorages. The strands are stressed and locked-off individually. The post-tensioning of such systems enables slab deflections and cracks under severe service conditions to be kept under control. This permits larger spans and thicker slabs to be used. The reduced materials and labor results in lower costs and faster construction. Additionally, there can be indirect savings on foundations, columns, walls and vertical surfaces.

In normal use in such existing multi-strand post-tensioning systems, the ends of the strand will extend through separate holes formed in an anchorage body. Typically, a plastic trumpet will interconnect the anchorage body to the flat tendon-containing duct. The strands will extend through tapered holes formed in the anchorage body. Normally, the strands will be angularly offset from one another as they extend through the anchorage body.

After installation, wedges are placed around the exterior of each of the outwardly-extending strands. A jack is used so as to stress the strands. The wedges will remain in contact with the strands during the stressing operation. After the jack has sufficiently stressed the strands, the pressure in the jack is released so that the wedges automatically seat in the conical holes of the anchor head.

After the strands are wedged into the holes of the anchor, it is then necessary to grout the interior of the anchor and the interior of the duct. In order to facilitate the grouting of such duct, a grout hole is machined into the body of the anchor. Under existing systems, a hole is drilled and tapped through the body of the anchor so as to communicate with the interior of the duct. After the hole is machined and tapped, a special fitting is installed so as to connect a grout tube with this hole. The grout tube is then free to pass grout into the interior of the duct so that grout can be used to fill the interior of the duct and to solidify on the interior of the duct. Normally, the drilled and tapped hole in the anchorage body extends transverse to the tendon-receiving passageways so as to open on a top surface of the anchorage body. After the grout is pumped into the interior through this machined hole, the grout tube must be removed from the fitting and the hole should be sealed.

Unfortunately, the forming of such a grout hole makes the anchor very expensive. Under conventional circumstances, the anchor is made of a cast metal. The machining and forming of the grout hole on such anchorages is a time consuming and expensive operation. Often, the machining operations required so as to form the grout hole can double or triple the cost of the anchor body itself. As such, a need has developed in which to provide a grout hole on such multi-strand post-tensioning systems which is less expensive and easier to use.

It is object of the present invention to provide an anchor for a multi-strand post-tensioning system which is easy to use and relatively inexpensive.

It is another object of the present invention to provide an anchor for a multi-strand post-tensioning system which eliminates machining operations.

It is a further object of the present invention to provide an anchor for a multi-strand post-tensioning system which eliminates the use of complex fitting and attachment mechanisms between the grout tube and the anchor.

It is still a further object of the present invention to provide a method for the grouting of such multi-strand post-tensioning systems which simplifies procedures, reduces costs, and eliminates unnecessary equipment.

It is another object of the present invention to provide an anchor/pocketformer arrangement which can be secured to a form board without nails or other cumbersome attachment devices.

These and other objects and advantages of the present invention will become apparent from a reading of the attached specification and appended claims.

SUMMARY OF THE INVENTION

The present invention is an apparatus for a multi-strand anchorage system which comprises an anchor plate having a front side and a back side.. a plurality of tendon-receiving passageways formed in the anchor plate, and a hole formed in the anchor plate and extending so as to open on a front side and on a back side of the anchor plate. Each of the tendon-receiving passageways opens on the front side and opens on the back side of the anchor plate.

In the present invention, each of the tendon-receiving passageways tapers so as to have narrow diameter adjacent the back side of the anchor plate and a wide diameter adjacent to the front side of the anchor plate. The hole is an unmachined hole. In particular, this hole is formed by the casting of the anchor plate. The hole, in particular, is a linear hole. The hole has a constant diameter along the length of the hole. The tendon-receiving passageway and the hole extend through the width of the anchor plate and extend transverse to the length of the anchor plate. In the preferred embodiment of the present invention, the hole is positioned between adjacent passageways of the plurality of tendon-receiving passageways.

The present invention is also a method for the grouting of a multi-strand post-tensioning system which includes the steps of: (1) forming an anchor plate having a plurality of tendon-receiving passageways extending from a front side to a back side of the anchor plate and a grout-receiving hole extending through the anchor from the front side to the back side of the anchor plate; (2) extending tendons through the tendon-receiving passageways of the anchor plate; (3) attaching a tendon-containing duct to the back side of the anchor plate; (4) stressing the tendons on the front side of the anchor plate; and (5) injecting grout through the hole into the tendon-containing duct.

In the method of the present invention, the step of forming the anchor plate includes casting the anchor plate so as to form the tendon-receiving passageways and the hole. The hole is cast so as to open on the front side and open on the back side of the anchor plate and to extend in a linear fashion through the width of the anchor plate. The hole is cast so as to be positioned between adjacent tendon-receiving passageways.

In the method of the present invention, the step of injecting grout includes the steps of affixing a grouting cap to the front side of the anchor plate, and passing grout through the cap and into the hole of the anchor plate. The grouting cap is formed so as to fit onto a surface of the anchor plate. The grouting cap has a tube which extends into the hole of the anchor plate.

In the method of the present invention, the grout is solidified on an interior of the tendon-receiving duct. Grout is injected through the hole so as to generally fill an interior area of the duct. The method further includes the steps of placing wedges into the tendon-receiving passageways on an exterior of the tendon within each of the passageways, releasing the tendons from the stressed condition, and cutting an excess portion of each of the tendons extending outwardly of the front side of the anchor plate.

DETAILED DESCRIPTION OF THE INVENTION

Figure 1:
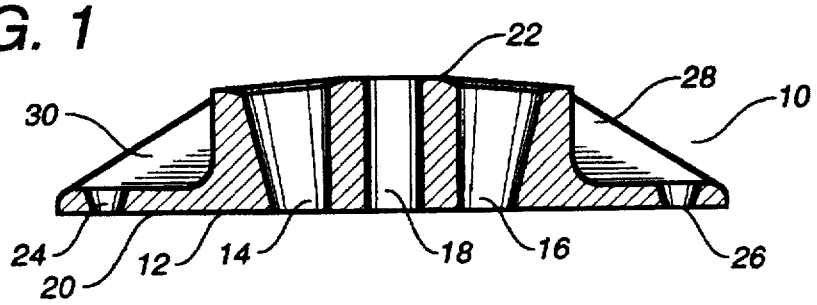
FIG. 1 is a cross-sectional view of the multi-strand anchor plate in accordance with the preferred embodiment of the present invention.

Referring to FIG. 1, there is shown at 10 the apparatus of the present invention for the multi-strand anchorage system. The apparatus 10 includes an anchor plate 12 having a plurality of tendon-receiving passageways 14 and 16 and a grout-passing hole 18.

The anchor 12 of the present invention has a back side 20 and a front side 22. The back side 20 has a generally flat configuration. Holes 24 and 26 are provided on the anchor 12 so as to facilitate the ability to nail, or otherwise attach, the anchor 12 to a vertical surface. Each of the tendon-receiving passageways 14 and 16 open on the back side 20 of the anchor 12. Additionally, the grout-passing hole 18 opens on the back side 20 of the anchor 12.

The front side 22 of the anchor 12 is formed opposite the back side 20. Gussets 28 and 30 extend from the ends of the anchor upwardly toward the top surface 22. It can be seen that the tendon-receiving passageways 14 and 16, along with the hole 18, open on the front side 22 of the anchor plate 12.

The anchor plate 12 is formed by casting. During the casting operations, the tendon-receiving passageways 14 and 16 are formed. Additionally, and importantly, in the present invention, the grout-passing hole 18 is formed by the casting operation. After the anchor 12 is cast, it is ready for use. It is possible that plastic encapsulations can be affixed or formed around the exterior surface of the anchor plate 12, if necessary. The present invention provides an enormous cost savings by the forming of the tendon-receiving passageways 14 and 16, and by the forming of the grout-passing hole 18, through the process of casting. It is not necessary to machine special holes for the passing of grout into the interior of the tendon-containing duct. Grout can be effectively pumped into the tendon-receiving duct through the grout-passing duct 18.

As can be seen in FIG. 1, each of the tendon-receiving passageways 14 and 16 tapers so as to narrow from the front surface 22 toward the back surface 20 of anchor plate 12. In other words, the tendon-receiving passageways 14 and 16 have a narrow diameter adjacent to the back side 20 of the anchor plate 12 and have a wide diameter adjacent the front side 22 of the anchor plate 12. This tapered configuration is used in such multi-strand systems since it is important to be able to affix wedges for the securing of the tendon within such passageways 14 and 16.

The grout-passing hole 18 opens, at one end, on the front side 22 and the at the other end to the back side 20 of the anchor plate 12. The hole 18 is a linear hole having a constant diameter therethrough. The hole 18 is positioned between the tendon-receiving passageways 14 and 16. The positioning of the hole 18 between the tendon-receiving holes 14 and 16 facilitates the ability to pump grout into the interior area of the tendon-containing duct (to be described hereinafter).

Figure 2:
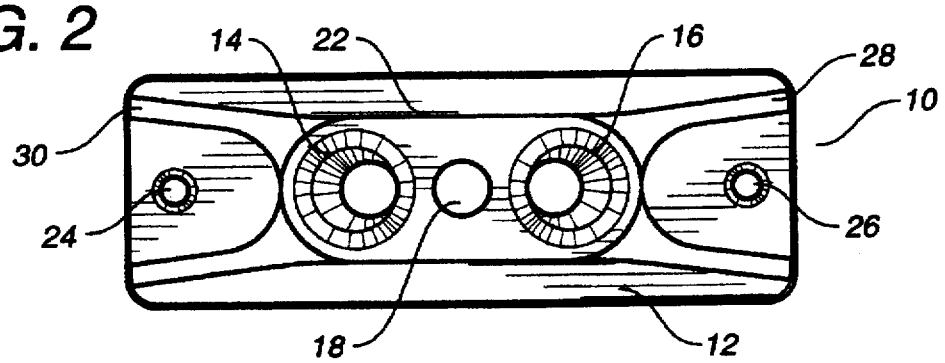
FIG. 2 is a top view of the multi-strand anchor plate in accordance with the present invention.

It is important to note that various other embodiments of the present invention are possible. In particular, it is not a critical requirement that the hole 18 be positioned between adjacent pairs of the tendon-receiving passageways 14 and 16. It is possible that the hole 18 can be formed to one side or the other of the tendon-receiving passageways. Additionally, FIGS. 1 and 2 illustrate anchorages for the receiving of two-tendon multi-strand systems. However, the anchorage of the present invention is equally applicable to multiple-strand systems which employ a greater number of tendons. The configuration of the anchor 12 is the configuration of one type of anchor that is possible within the concept of the present invention. Various other forms of anchors are possible within the scope of the present invention.

FIG. 2 is a frontal view of the apparatus 10 of the present invention. In particular, in FIG. 2, it can be seen that the anchor plate 12 has a generally rectangular configuration. Holes 24 and 26 are positioned in opposite ends of the anchor plate 12. The Gussets 28 and 30 extend upwardly toward the front surface 22 from the end of the anchor plate 12. The gussets 28 and 30 serve as structural supports for the integrity of the anchor plate 12. The tendon-receiving passageways 14 and 16 are shown as opening on the front surface 22. Similarly, the grout-passing hole 18 is shown as opening on the front surface 22.

Figure 3:
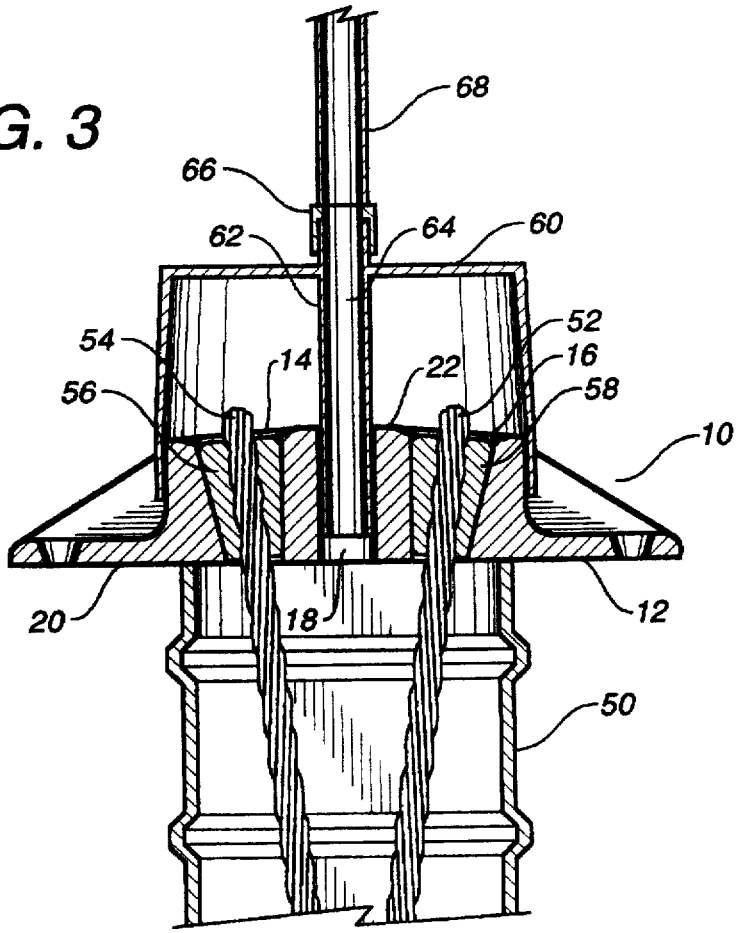
FIG. 3 is a cross-sectional side view of the installation technique of the present invention.

FIG. 3 illustrates the method of the present invention. Initially, in the method of the present invention, the anchor plate 12 is formed by the casting of the anchor plate 12, along with the tendon-receiving passageways 14 and 16 and the grout-passing hole 18. The anchor plate 12 should be cast of a steel material. It can be seen that the duct 50 is affixed to the back side 20 of the anchor plate 12. The duct 50 contains two or more tendons therein. In the embodiment shown in FIG. 2, two tendons are received within the duct 50. The end of the duct 50 can be secured to the anchor plate 12 in a conventional manner. Typically, as used in conventional systems, the duct 50 will be affixed to a plastic trumpet extending from an encapsulation around the anchor plate 12. It can be seen in FIG. 3 that the tendons 52 and 54 extend through the tendon-receiving passageways 14 and 16 and terminate on the front side 22 of the anchor plate 12. It can also be seen that the grout-passing duct 18 opens on the back side 20 of the anchor plate 12 so as to communicate with the interior of the duct 50.

In the method of the present invention, the tendons are stressed in a conventional fashion. Wedges 56 and 58 are placed over the tendons 52 and 54 so as to secure the position of the tendons 52 and 54 within each of the tendon-receiving passageways and 16, respectively. After the tendons have been stressed and released, the wedges 56 and 58 will seat themselves within the passageways 14 and 16. The ends of the tendons 52 and 54 can then be cut at a position adjacent to the front surface 22 of anchor plate 12. This process is very similar to the process employed in conventional multi-strand post-tensioning systems.

The important difference of the present invention is the manner in which grout is introduced into the interior of the duct 50. In the method of the present invention, a grout cap 60 will be affixed onto a surface of the anchor plate 12. The grout cap 60 can be formed of a plastic material which can be secured to the outer edges of the anchor plate 12. The grout cap 60 can be secured by wiring, snap-fitting, or other means for attachment.

The grout cap 60 is formed so as to have a grout-passing tube 62 which extends into the hole 18. The tube 62 has an interior passageway 64 for the passing of grout therethrough. A fitting 66 is formed on an outer surface of the grout cap 60 so as to connect to a grout tube 68. By fitting the tube 62 into the hole 18, the grout can be passed through the hole 18 and into the interior of the duct 50 by pumping grout through the grout tube 68. Grout will be pumped through the tube 68 and into the interior of the duct 50 until voids in the duct 50 are filled with grout.

After the duct 50 is appropriately filled with grout, the grout tube 68 can be removed from the fitting 66. Since the grout cap 60 is made of an inexpensive plastic material, the grout cap 60 can be retained in position over the ends of the tendons 52 and 54. As a result, it will not be necessary to affix any other type of cap over the front surface 22 of the anchor plate 12.

In the present invention, the formation of the grout-passing hole 18 during the casting of the anchor 12 eliminates the need to machine transverse holes on the anchor plate. By the special method of the present invention, the hole 18 can be used instead of such machined holes. As a result, the anchor plate 12 can be manufactured in an inexpensive manner. It is not necessary to drill and tap holes into the anchor plate so as to allow grout tubes and special fittings to be connected for the purpose of filling the duct 50. In the method of the present invention, the present invention provides a cap that can be secured to the outer surface of the anchor plate 12 for the purpose of sealing the ends of the tendons and for closing the interior of the duct. The present invention offers significant cost savings and allows the installation of multi-strand post-tensioning systems in a convenient and simpler manner than conventional systems.

Figure 4:
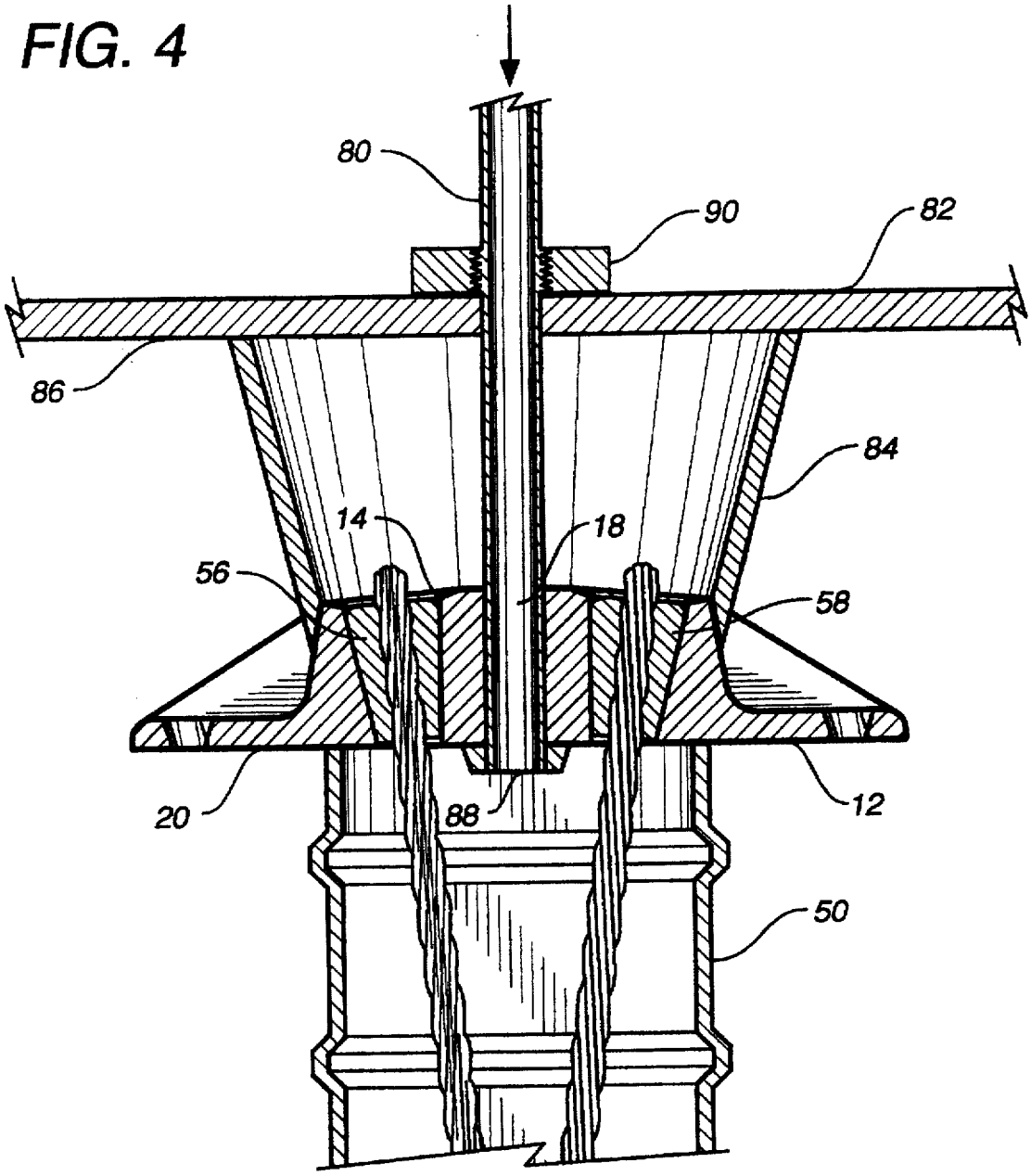
FIG. 4 is an illustration of an installation technique using the present invention in which a grout-passing tube is used to secure the anchor into a desired position.

Referring to FIG. 4, an alternative embodiment of the present invention is presented. In the alternative embodiment of FIG. 4, a grout tube 80 is provided which can be used for the purpose of passing grout into the interior of the duct 50 and can also be used for the securing of the anchor 12 to a form board 82 without the need for nails or other cumbersome attachment devices. As can be seen in FIG. 4, a pocketformer member 84 is secured to the anchor 12. Pocketformer 84 extends from the anchor 12 so as to be in abutment with an interior surface 86 of the form board 82. The grout tube 80 extends through the hole 18 on the interior of the anchor 12. An abutment member 88 is provided on the end of the grout tube 80 so as to secure the grout tube 80 within the hole 18 of the anchor 12. The grout tube 80 will extend through the hole 18 and through an opening in the form board 82. The grout tube 80 can be provided with threads so that a nut 90 can be threadedly attached thereto so as to affix the grout tube 80 in position against the form board 82. There are also a variety of other connection devices available whereby the grout tube can be secured to the form board. By affixing the nut 90 on the threaded portion of the grout tube 80, the pocketformer 84 and the anchor 12 will remain in a proper position juxtaposed against the interior surface 86 of the form board 82. The securing of the anchor 12, in this manner, eliminates the need for nails and other attachment devices. The anchor 12 can be easily installed in its proper position by simply threading the nut 90 onto the grout tube 80. Grout can be passed through the interior of the grout tube 80 and into the duct 50. Additionally, grout can be used to fill the voids around the pocketformer 84. As such, the incorporation of the grout tube 80 provides an easy means for placement of the anchor relative to the form board 82.

The foregoing disclosure and description of the invention is illustrative and explanatory thereof. Various changes in the details of the illustrated construction, or in the steps of the described method, may be made within the scope of the appended claims without departing from the true spirit of the invention. The present invention should only be limited by the following claims and their legal equivalents.

I claim:

1. A method of grouting a multi-strand post-tensioning system comprising the steps of:

forming an anchor plate having a plurality of tendon-receiving passageways extending from a front side to a back side of said anchor plate and a grout-passing hole extending through said anchor plate from said front side to said back side;

extending tendons through said plurality of tendon-receiving passageways;

attaching a tendon-containing duct to said back side of said anchor plate;

stressing said tendons on said front side of said anchor plate;

affixing a grouting cap onto said front side of said anchor plate so as to cover said tendons on said front side of said anchor plate, said cap having a tubular portion extending into said grout-passing hole; and passing grout through said tubular portion of said cap and into said hole of said anchor plate.

2. The method of claim 1, said step of forming comprising the step of:

casting said anchor plate so as to form said tendon-receiving passageways and said grout-passing hole, each of said tendon-receiving passageways tapering so as to have a wide diameter at said front side and a narrow diameter at said back side.

3. The method of claim 1, said step of forming further comprising the step of:

casting said anchor plate so as to form said hole therein in axially transverse relationship to said front side of said anchor plate.

4. The method of claim 3, said step of forming further comprising the step of:

casting said anchor plate such that said hole is positioned between adjacent tendon-receiving passageways.

5. The method of claim 1, said step of injecting comprising the step of:

injecting grout through said hole so as to generally fill an interior area of said duct.

6. The method of claim 1, said grout-receiving hole being an unmachined cast hole.

7. The method of claim 1, further comprising the steps of:

placing wedges into said tendon-receiving passageways on an exterior surface of each of said tendons within each of said passageways following said step of stressing;

releasing said tendons from the stressed conditions such that said wedges retain said tendons in said passageways; and cutting an excess portion of each of said tendons extending outwardly of said front side of said anchor plate.

* * * * *